US006606810B1

(12) United States Patent
Doucet

(10) Patent No.: US 6,606,810 B1
(45) Date of Patent: Aug. 19, 2003

(54) UNIQUE DISPLAY KIT AND METHOD FOR CREATING UNIQUE DISPLAYS

(76) Inventor: Deborah J. Doucet, P.O. Box 758, Glen, NH (US) 03838

( * ) Notice: Subject to any disclaimer, the term of this patent is extended or adjusted under 35 U.S.C. 154(b) by 0 days.

(21) Appl. No.: 09/518,861

(22) Filed: Mar. 3, 2000

Related U.S. Application Data

(60) Provisional application No. 60/124,745, filed on Mar. 17, 1999.

(51) Int. Cl.[7] ..... A47G 1/06
(52) U.S. Cl. ..... 40/711; 40/726
(58) Field of Search ..... 40/711, 537, 725, 40/771, 775, 721, 765, 726; 402/79

(56) References Cited

U.S. PATENT DOCUMENTS

| | | | | | |
|---|---|---|---|---|---|
| 2,649,799 | A | * | 8/1953 | Spertus | 40/721 |
| 3,616,558 | A | * | 11/1971 | Jahn | 40/711 |
| 4,001,960 | A | * | 1/1977 | Holson | 40/726 |
| 4,164,085 | A | * | 8/1979 | Steeb et al. | 40/726 |
| 4,172,332 | A | * | 10/1979 | Holes et al. | |
| 4,215,499 | A | | 8/1980 | Wilson | |
| 4,259,799 | A | | 4/1981 | Fulton | |
| 4,794,713 | A | | 1/1989 | Yang | |
| 4,824,273 | A | * | 4/1989 | Silva et al. | 402/79 |
| 4,852,282 | A | | 8/1989 | Selman | |
| 4,912,864 | A | * | 4/1990 | Price | 40/711 |
| 4,998,361 | A | * | 3/1991 | Gordon | 40/721 |
| 5,040,216 | A | * | 8/1991 | Policht | 281/46 |
| 5,077,921 | A | | 1/1992 | Mooney | |
| 5,303,489 | A | | 4/1994 | Blegen | |
| 5,661,918 | A | * | 9/1997 | Malcolm et al. | 40/107 |
| 5,709,409 | A | | 1/1998 | Engel | |
| 5,816,730 | A | | 10/1998 | Alspaw | |
| 5,904,373 | A | * | 5/1999 | Krapf | 281/29 |
| 5,918,394 | A | * | 7/1999 | Babcock | 40/122 |
| 6,003,901 | A | * | 12/1999 | Takemura | 281/33 |
| 6,019,539 | A | * | 2/2000 | Lynton | 402/79 |
| 6,039,495 | A | * | 3/2000 | Zimmerman et al. | 402/79 |
| 6,052,933 | A | * | 4/2000 | Lytle | 40/711 |

* cited by examiner

*Primary Examiner*—William Miller
(74) *Attorney, Agent, or Firm*—Lynne M. Blank

(57) ABSTRACT

An apparatus or kit is described for creating a standard sized display from assorted memorabilia. The apparatus includes frames for displaying such standard sized display as well as components for creating a long-term storage and display container to receive the standard sized display without additional creative effort. Also claimed is the method for using the apparatus or kit to create a single standard sized display for viewing and later transfer directly into a long-term storage or display container.

10 Claims, 13 Drawing Sheets

UNIQUE DISPLAY KIT AND METHOD FOR CREATING UNIQUE DISPLAYS

CROSS-REFERENCE TO RELATED APPLICATIONS

This is a 119(e) application of Provisional Application Serial No. 60/124,745, entitled Unique Display Kit and Method for Creating Unique Displays, filed Mar. 17, 1999.

BACKGROUND OF THE INVENTION

This invention relates to a kit for the preparation of a decorative page for display in a frame or holder on a refrigerator or other surface and subsequent display in a display book, which also stores and protects the collection of decorative pages.

Refrigerators and other vertical surfaces are frequently used as the display mechanisms for a variety of memorabilia, such as photographs, children's art works, cards, messages, and other items of interest. Frequently, these items are collected into scrapbooks or other containers for retention after display. Unfortunately, during display, the memorabilia items become dirty, curled, torn, or otherwise diminished in appearance. Important historical information in the form of names, dates, and places may be lost and forgotten during the display process and frequently cannot be recalled when compiled into a scrapbook.

One solution to the display problems has been to protect these items for display in frames or other display means. However, at some point, the items diminish in display desirability and are stored after removal from the display frames. In storage, these items are either mixed together with resulting loss of history or may further deteriorate in condition by being torn, curling or becoming soiled after storage next to something dirty. Deterioration and disorganization are encouraged.

Many people solve these storage problems by preparing attractive and/or organized books of memorabilia after removal of the items from display. However, there is no currently available means for creating a display, in a standard size, from memorabilia, placing this new display of memorabilia in a predetermined standard sized display media, which is matched to a standard sized storage and/or display container for storing long term. There is no current mechanism that allows transfer of the display, once created, directly to storage from display without additional work and the potential for deterioration or disorganization.

This can be illustrated by consideration of frame means. Frame means come in standard sizes, such as 5×7 inches, 8×10 inches. Scrapbook pages and materials, on the other hand, come in different sizes, such as 8 ½×11 inches, 11×14 inches, or 12×12 inches. The scrapbook sizes do not match the frame sizes, and accommodation must currently be made prior to transfer.

Typically, the display of memorabilia requires the original creation of a compilation of the memorabilia, for display on a vertical surface. Once the vertical display becomes old or out-dated, the display or separated component memorabilia is stored in a drawer or other location until again reorganized into a final display, such as a scrapbook, for long term storage. Since the display means and storage means, usually in the form of a scrapbook, are of two different sizes, two creative exercises are required: one for the original display, and; a second for long-term collection, display, and storage.

The present invention is more efficient. The memorabilia is used to create one display sheet. This one display sheet is used for viewing on a vertical surface, then transferred directly to final storage and/or display, without further work and resulting potential for loss or damage, either to the physical memorabilia or the related historical or nostalgic information.

SUMMARY OF THE INVENTION

This invention provides a unique method for creating a single display, displaying it, then storing the display in an organized and attractive manner which, while allowing for further collective display, as well as protection and preservation of the displayed material.

More specifically, this invention consists of a saleable apparatus or kit of packaged materials to make an attractive display sheet of a particular standard size. The package or kit also contains a display means, such as a magnetized frame, standardized to fit the size of the created display sheet. Finally the kit contains archival grade sheet holders and a final container for the sheet holders, again, of the particular standard size to match the created display and display means. As a result, the created display can be displayed and protected from damage while displayed, then immediately transferred to a sheet holder in a final container which will protect and store the display and at the same time create a further long term display.

BRIEF DESCRIPTION OF THE DRAWINGS ILLUSTRATING THE METHOD

Figure 14:
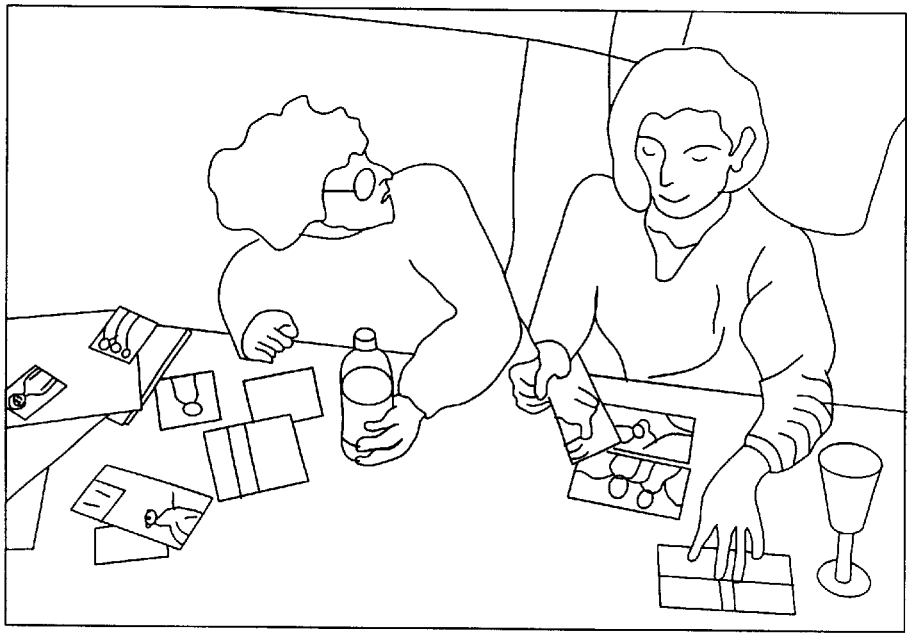

FIG. 14 illustrates the assembly of memorabilia.

FIGS. 15, 16, 17, 18, 19, 20, and 21 illustrate the attachment of the memorabilia to the standard sized display sheet and the decoration of the standard sized display sheet with representative artistic materials contained in the apparatus or kit.

Figure 22:
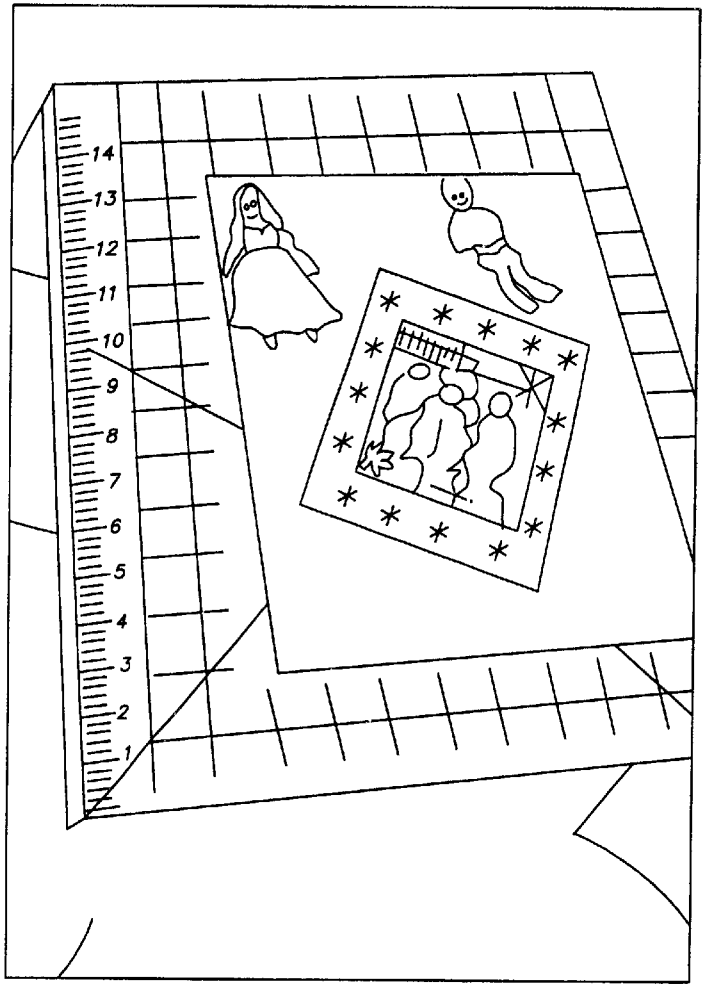
Figure 23:
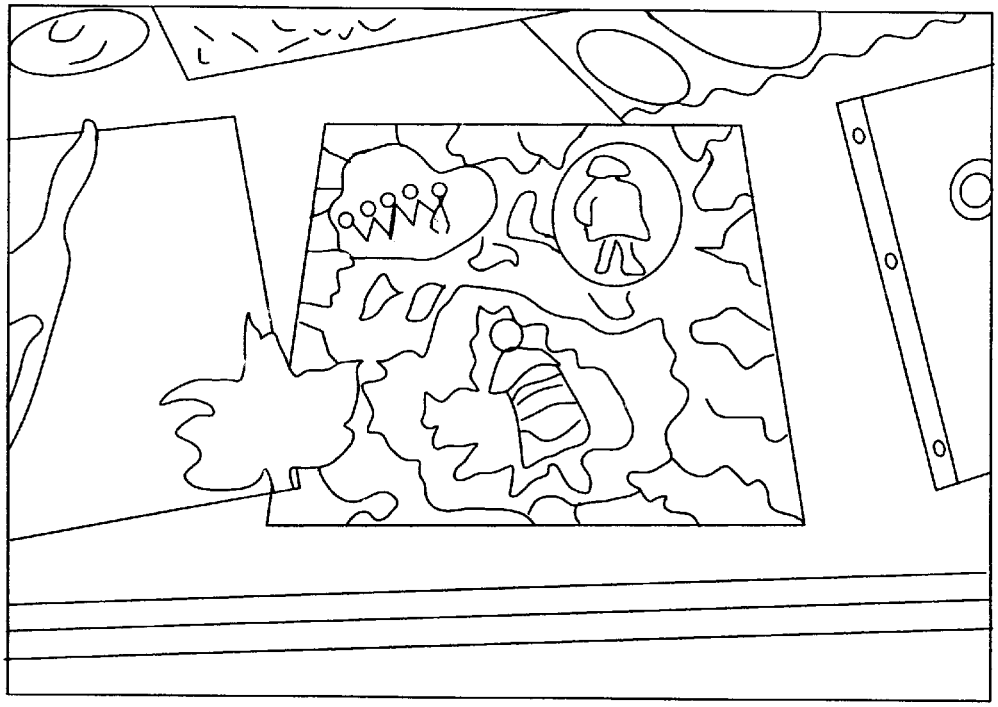

FIGS. 22 and 23 illustrate typical attractive, standard sized display sheets.

Figure 24:
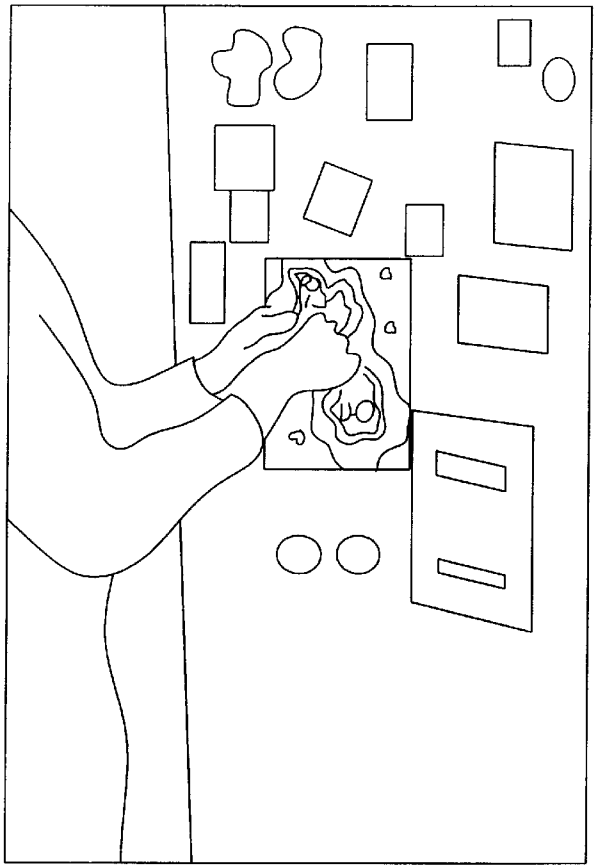

FIG. 24 illustrates the placement of the display sheet into the frame means.

Figure 25:
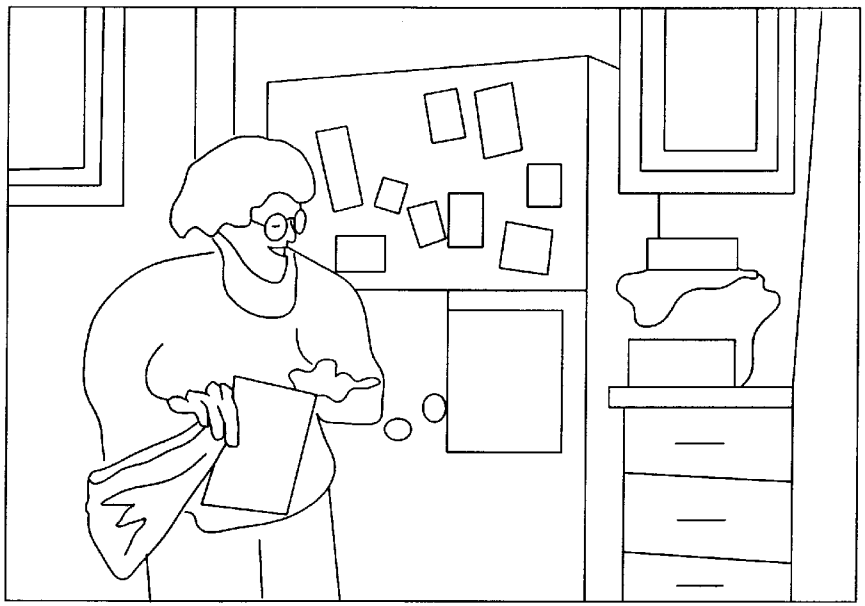

FIG. 25 illustrates the exhibition of the display sheet, here, on the refrigerator.

Figure 26:
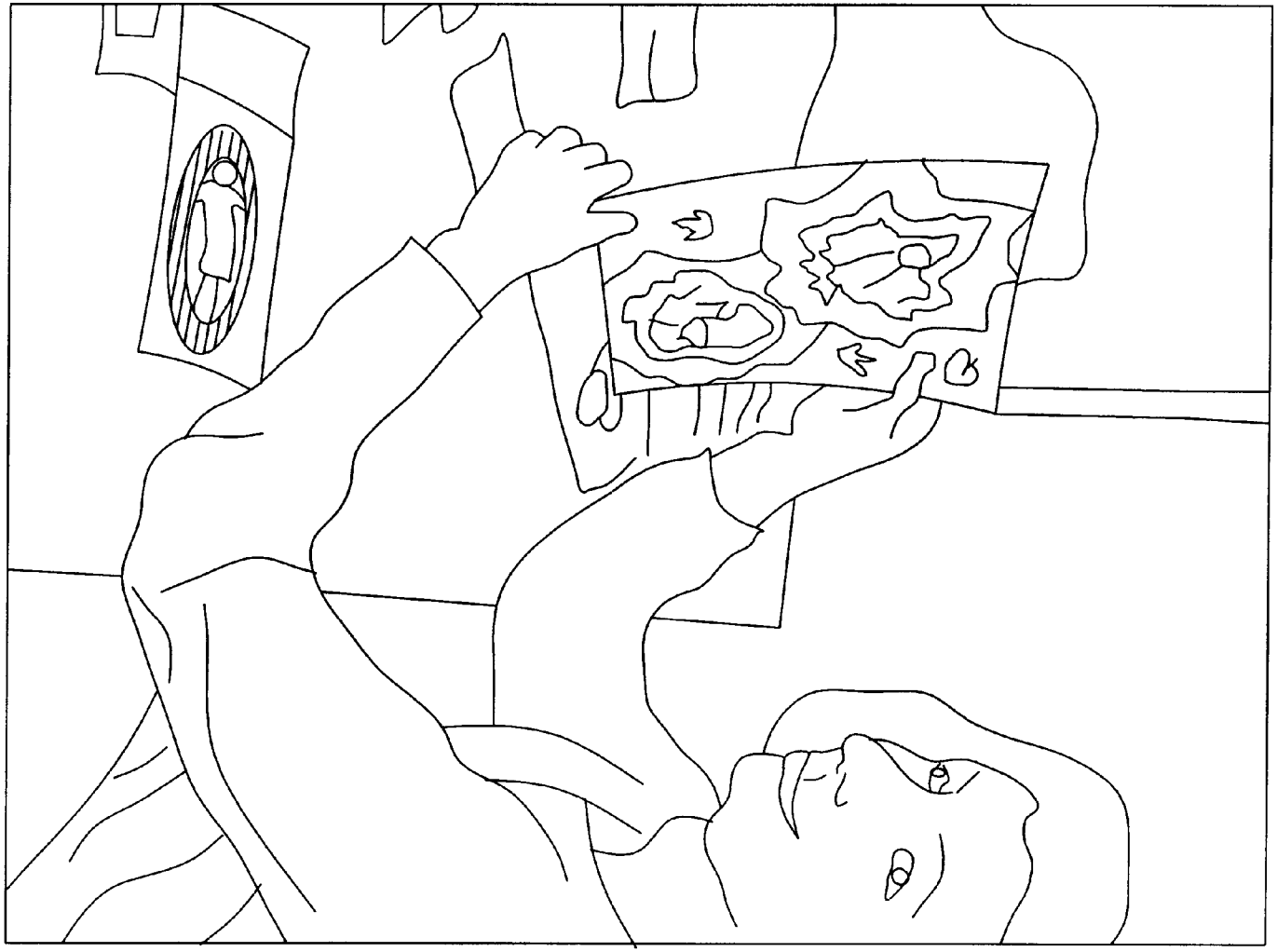

FIG. 26 illustrates the removal of the display sheet from the frame means and placement directly into the sheet holder, when the display creator tires of the display.

Figure 9:
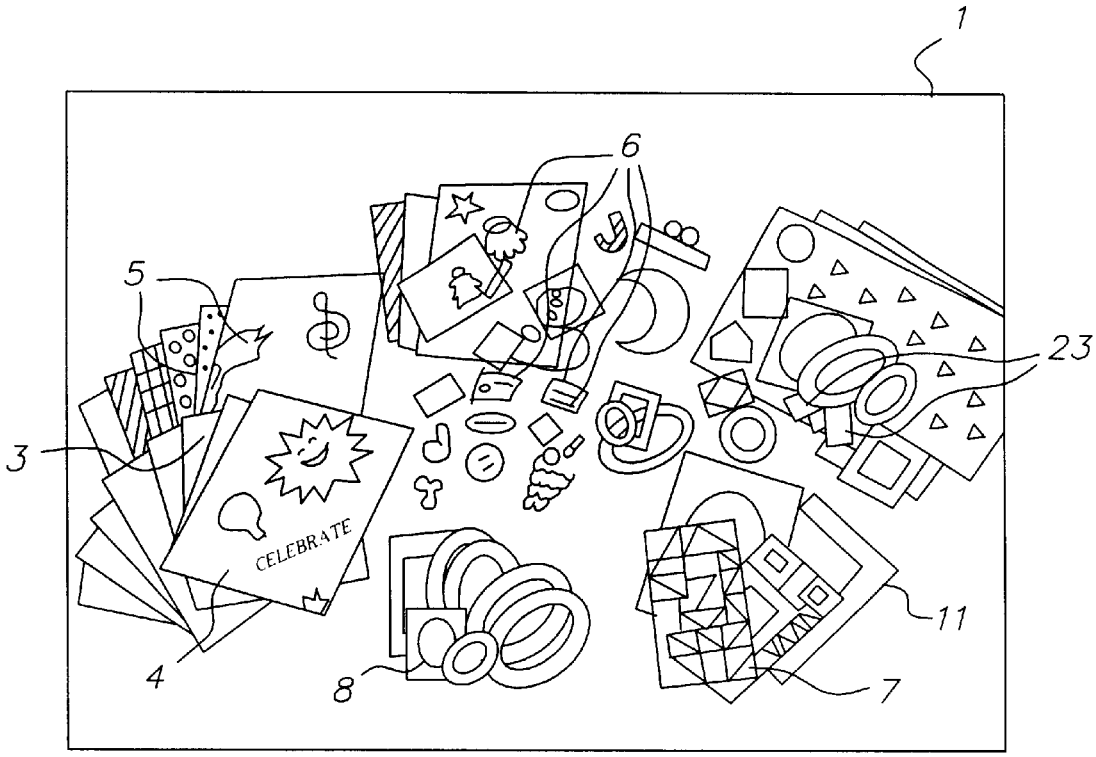
FIG. 9 is a photographic view of representative materials which may be included in the apparatus package or the kit for creation of the standard sized display sheet.
Figure 10:
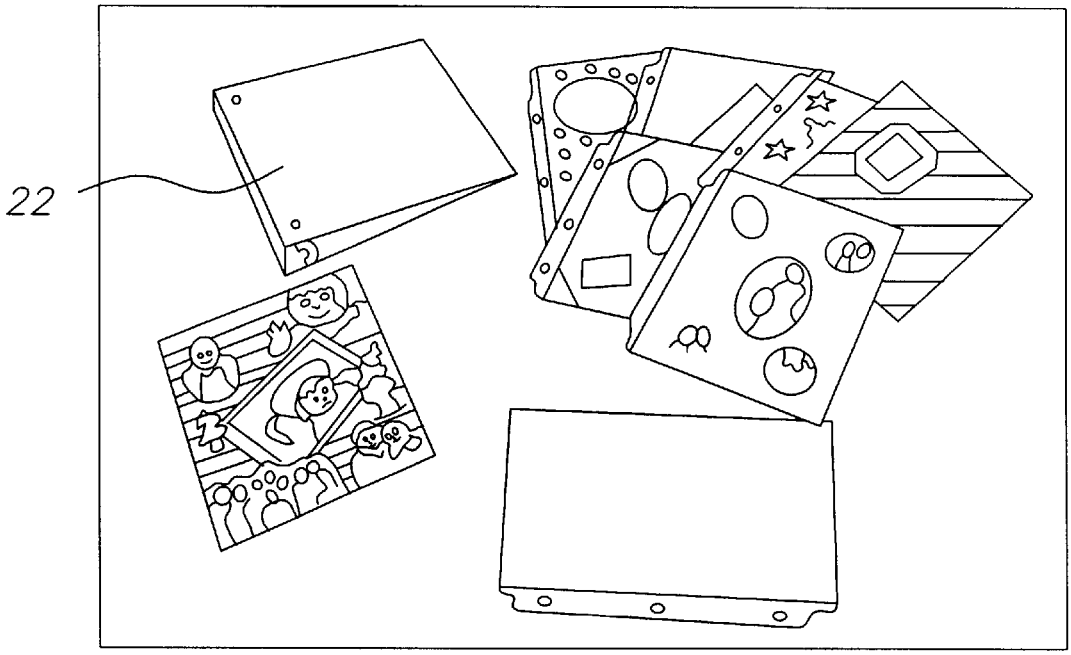
FIG. 10 is a view of the components of a typical apparatus or typical kit: prepared standard sized display sheets, a display means such as a frame, archival quality sheet holders and a final container for the sheet holders. An organizing pocket for organizing the materials is optionally included.
Figure 11:
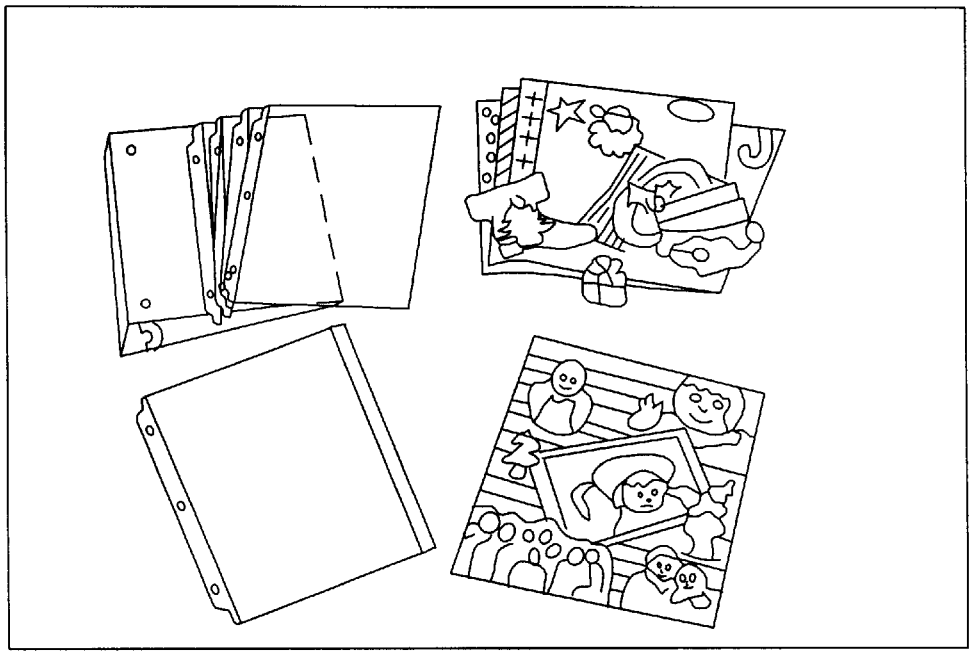
FIG. 11 is another view of a typical kit, with additional alternative materials used to create the standard sized display sheet.
Figure 13:
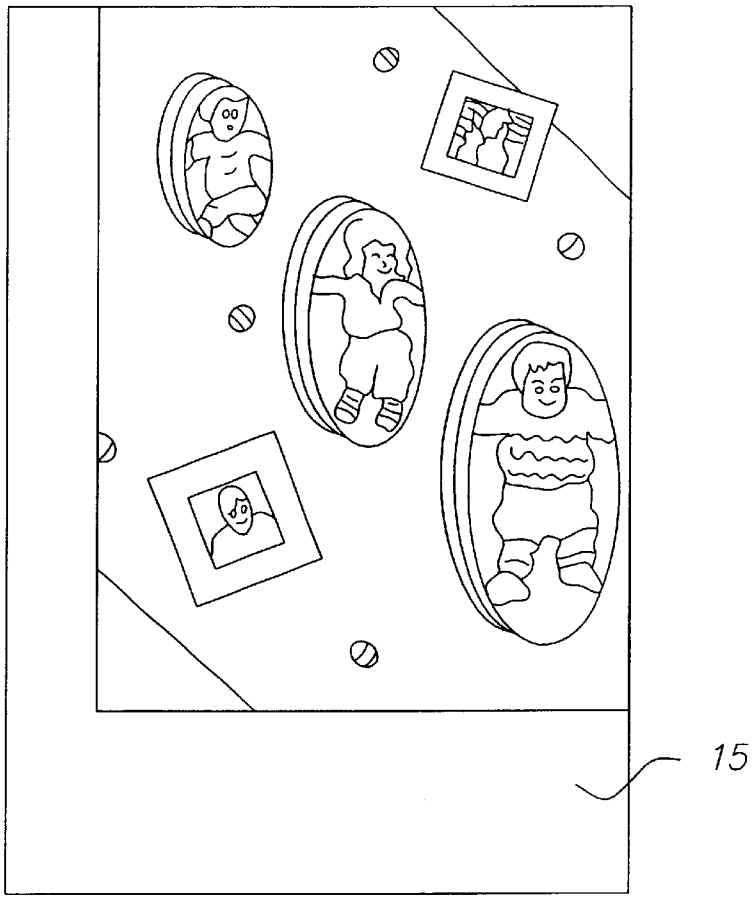
FIG. 13 is a close—up photographic view of a typical standard sized display sheet in a display means, displayed on a refrigerator.
Figure 12:
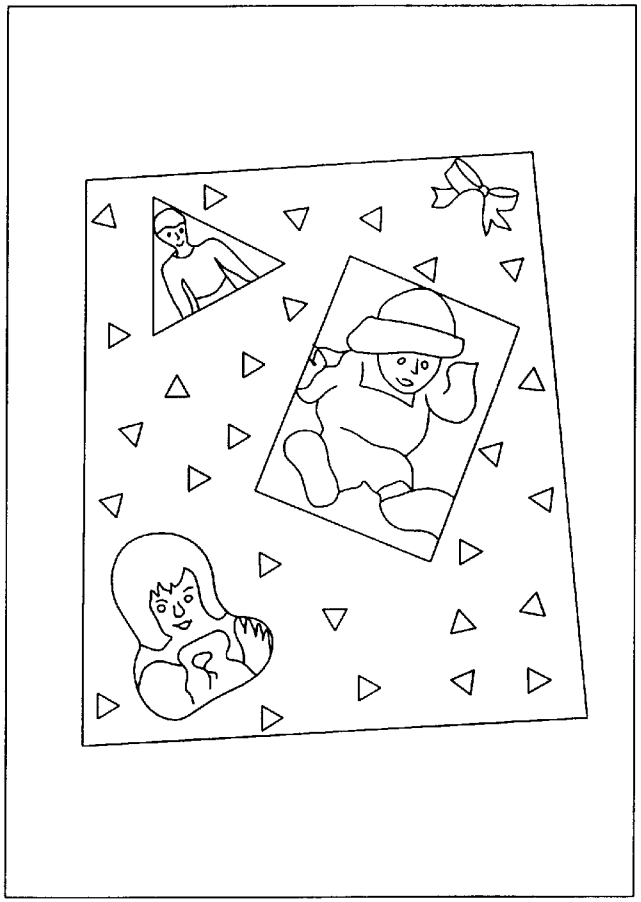
FIG. 12 is a photographic view of typical standard sized display sheets placed in a display means.
Figure 15:
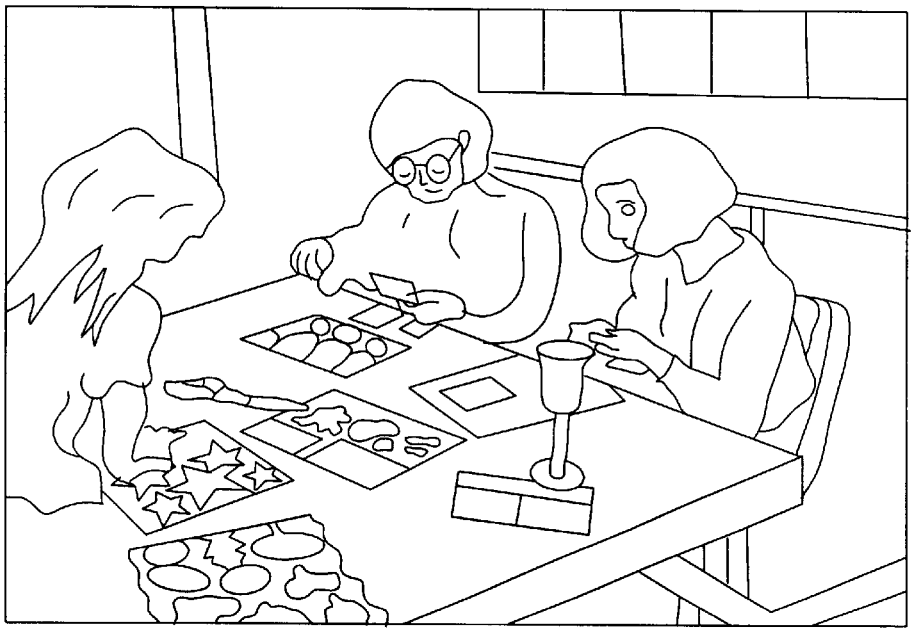
Figure 17:
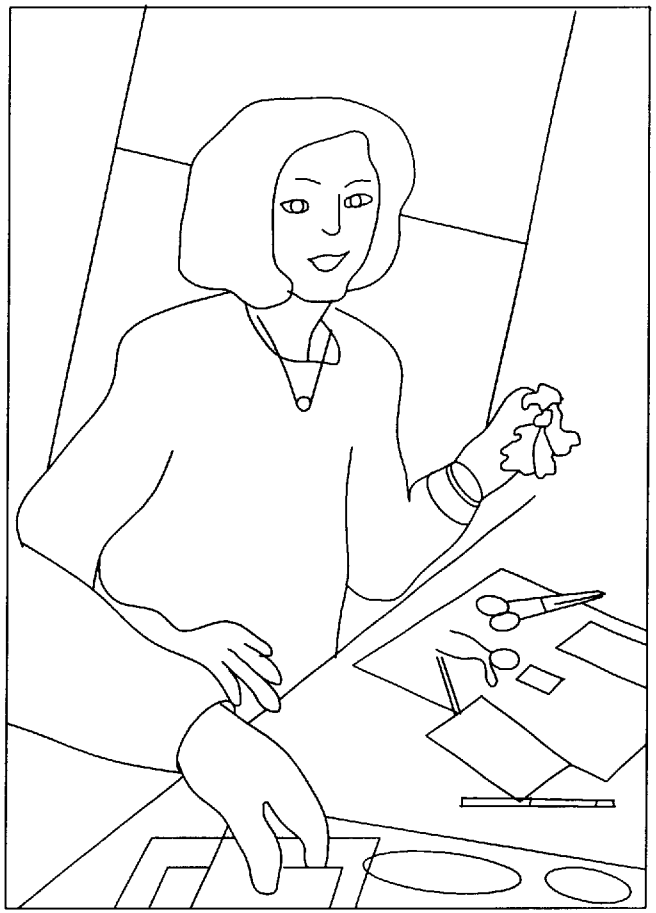
Figure 16:
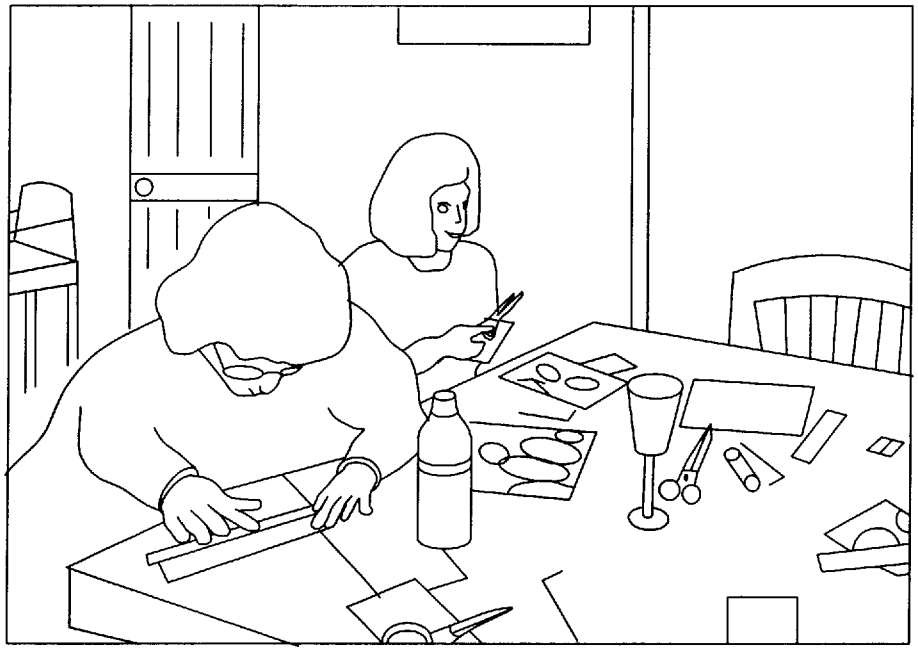
Figure 19:
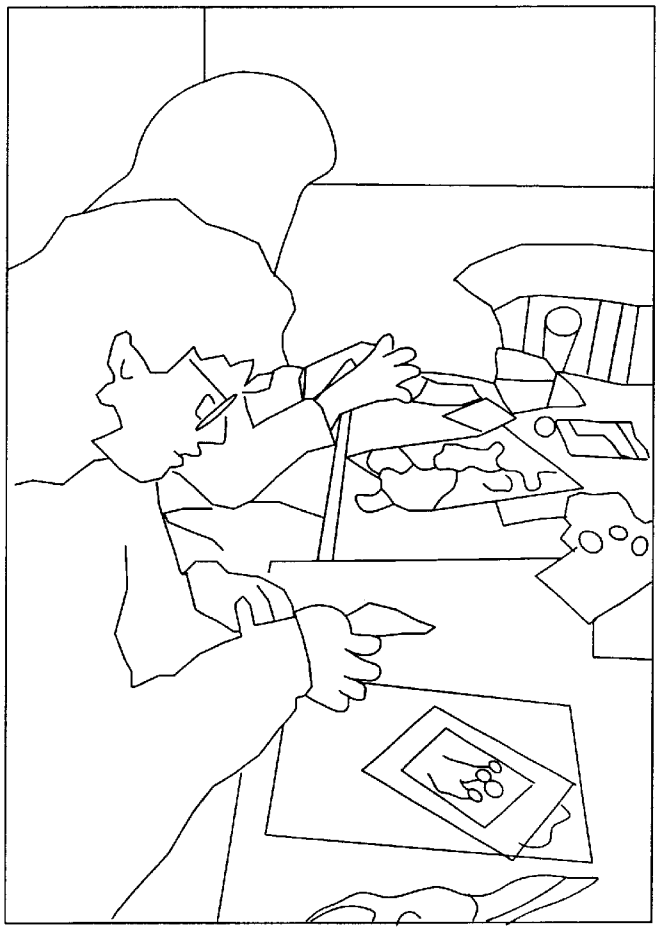
Figure 18:
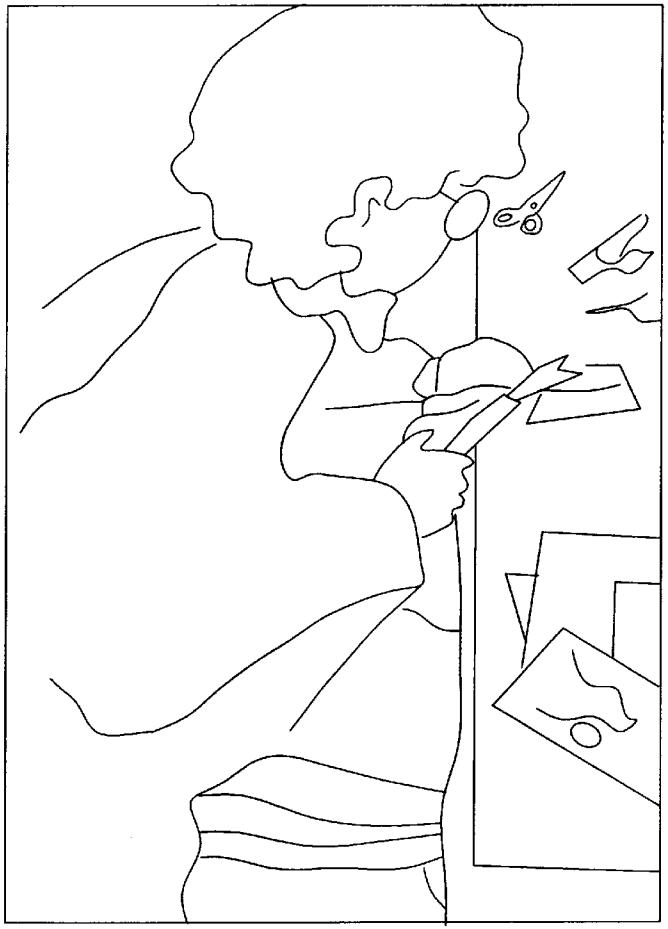
Figure 21:
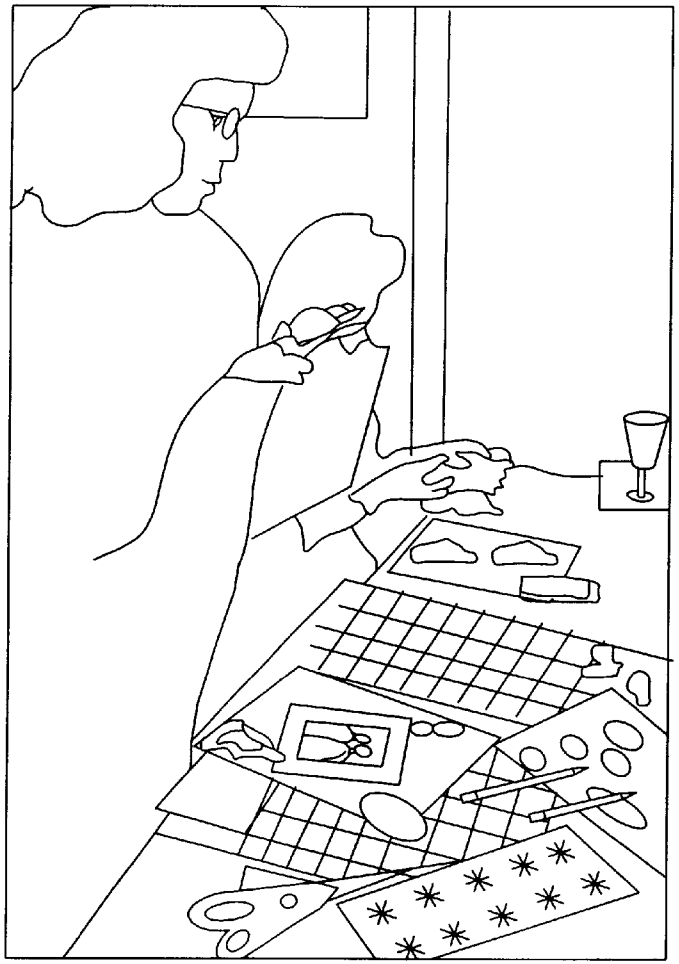
Figure 20:
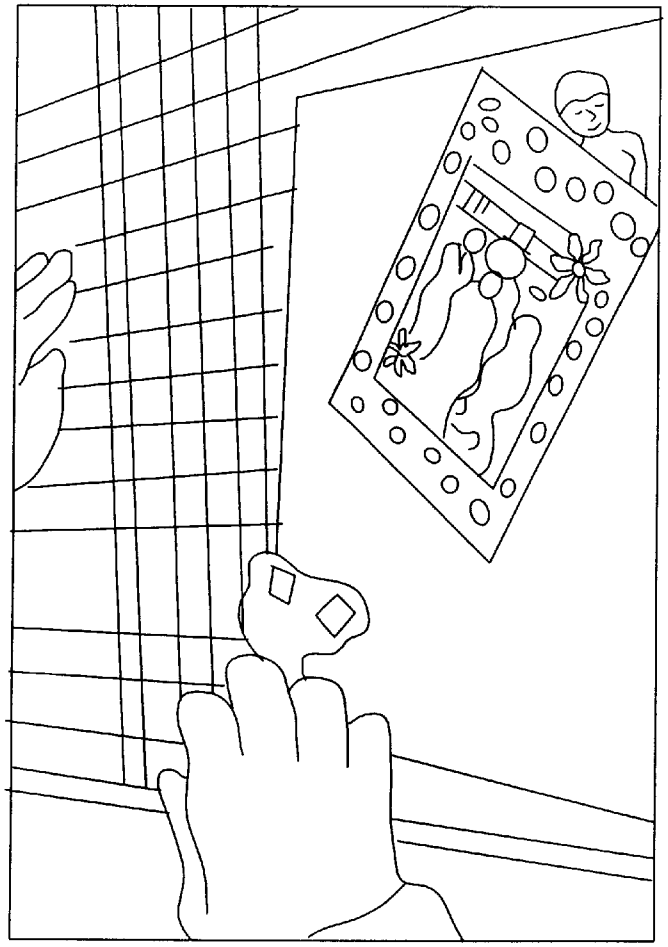

The preferred embodiment of the kit contains:

A selection of artistic materials 1, as shown in FIG. 9, used to create a standard sized, 8 ½×11 inch display sheet 2 of FIG. 15. These materials illustrated in FIG. 9 may include, but are not limited to, white 3, colored 4, or printed design 5 paper of standard 8 ½×11 inch sizes, decorative cut-outs or die-cuts 6, decorative rub-ons and stickers 23, adhesive comers and sticker frames 7, decorative mats 8, adhesive mats 9, pens, crayons, markers or pencils, paints, rubber stamping materials, clear and colored tapes, laces and ribbons 10, decorative fabric items 11, adhesive means such as glue, scissors, craft punches, stencils, or other artistic supplies.

Figure 3:
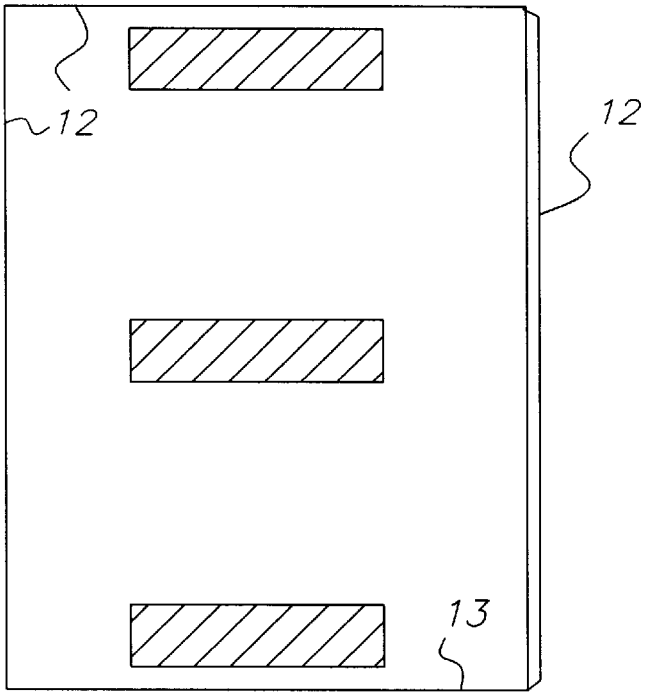
FIG. 3 is a front view perspective of one type of display means, a clear acrylic frame with magnetic elements for displaying a prepared standard sized display sheet.
Figure 4:
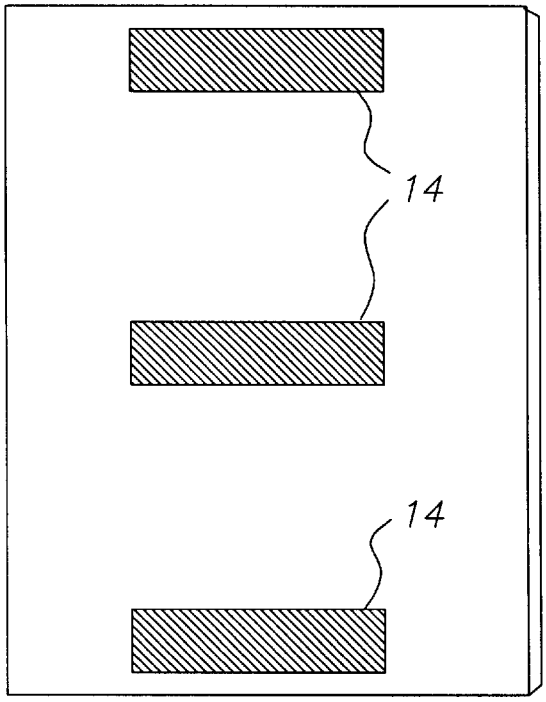
FIG. 4 is a back view perspective of a typical display means, a clear acrylic frame with magnetic elements for displaying a prepared standard sized display sheet.
Figure 5:
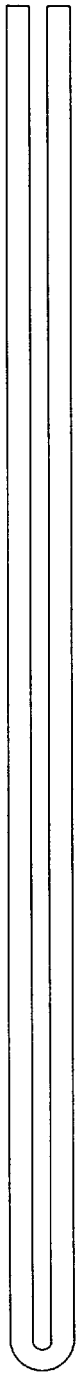
FIG. 5 is a side view perspective of the clear acrylic frame with magnetic elements for displaying a prepared standard sized display sheet.
Figure 6:
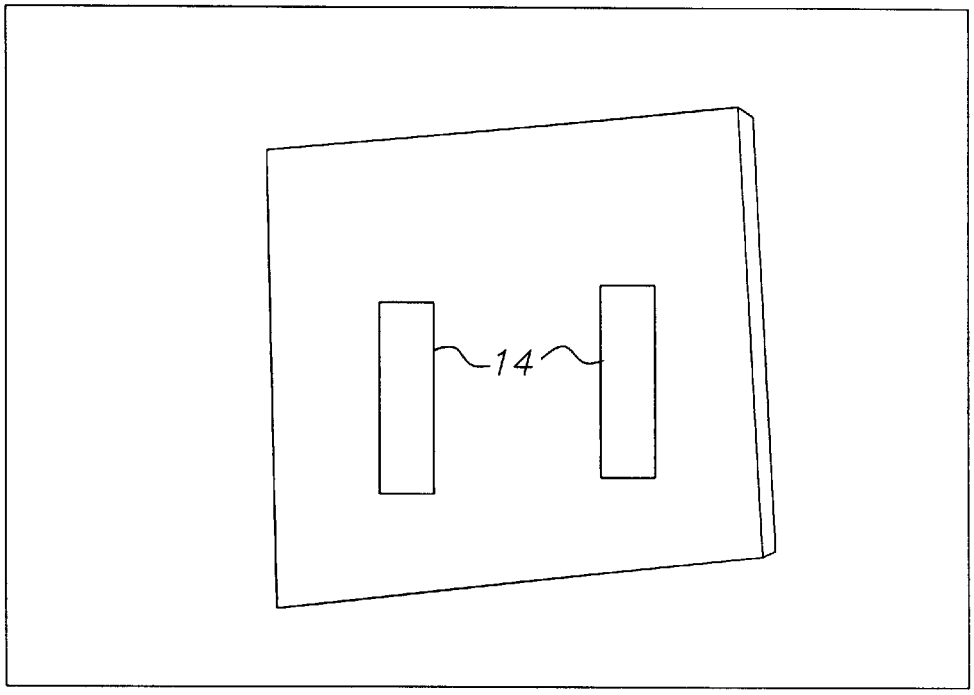
FIG. 6 is a photographic back view perspective of a second possible configuration for display means, here, a clear acrylic frame with magnetic elements used to display a prepared standard sized display sheet.

A frame mean, preferably comprised of clear acrylic, is illustrated in FIG. 6. The frame preferably has four edges, a back and a front: the front is illustrated in FIG. 3; the back is illustrated in FIG. 4, and; the edges are illustrated in FIG. 3, wherein three open edges 12 and one closed edge 13 are illustrated. Magnets 14, as seen in FIGS. 4 and 6, are attached to the back of the frame means to facilitate attachment and vertical display on a metal surface, preferably a refrigerator 15 as pictured in FIG. 17. The frame means is sized to perfectly fit the 8 ½×11 inch display sheets 2.

Figure 7:
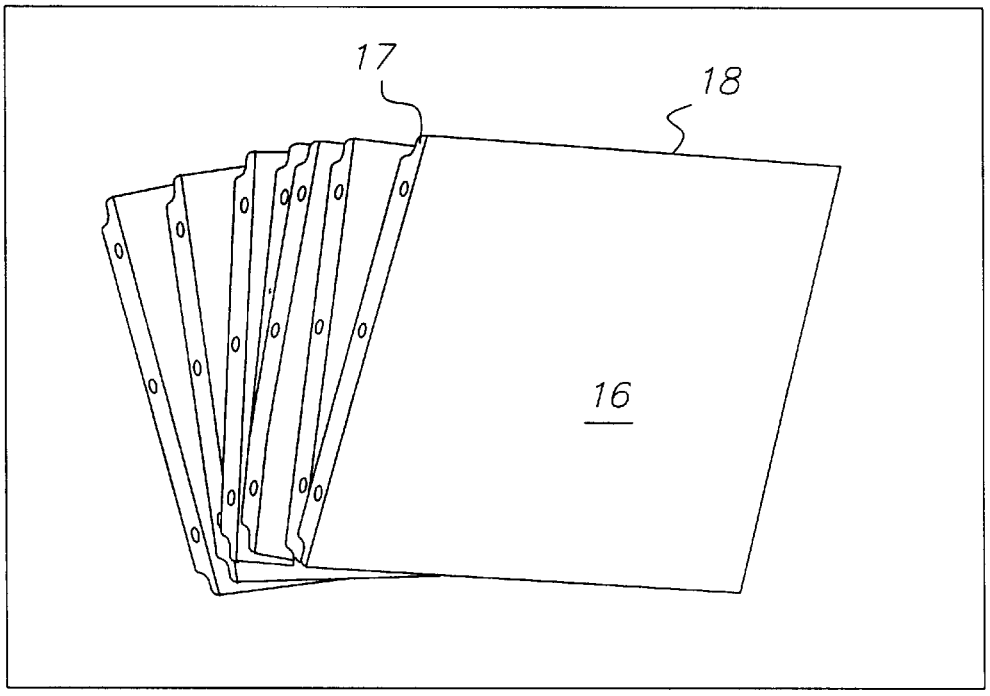
FIG. 7 is a photographic view of archival quality sheet holder elements.

Archival quality clear sheet holders 16, pictured in FIG. 7, having four edges, a front and a back, are three-hole perforated along one edge 17 to allow addition to a final sheet container. The clear sheet holders are sized to contain the 8 ½×11 inch display sheets. The sheet holder further has an opening to allow addition of the display sheet, along one of the three remaining edges 18.

A final sheet container in the form of a typical sized three-ring notebook, meant to contain 8 ½×11 inch papers, is included in the kit. The notebook can be of any color, texture, and may also be decorated. Although three-ring binders are preferred, other configurations are allowable, so long as they fit the 8 ½×11 inch sheets and can contain the sheet holders.

Figure 8:
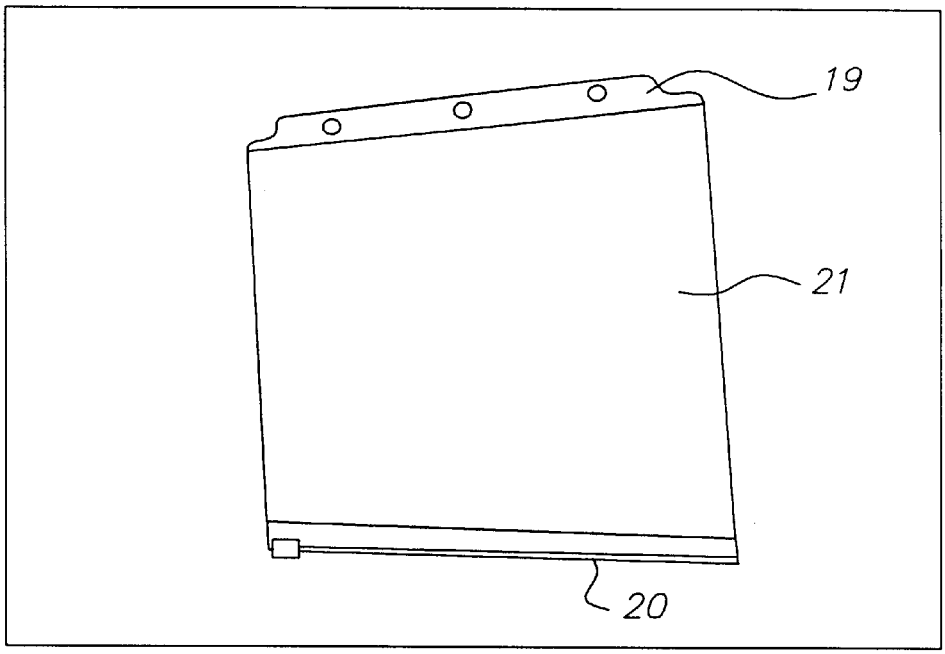
FIG. 8 is a photographic view of an optional element, an organizing pocket for containing the materials provided in the apparatus or kit for creation of the standard sized display sheet.

Optionally, an organizing pocket 21, illustrated in FIG. 8, may also be included. This pocket is perforated along one edge 19 to allow addition to the final sheet container and also has an opening means 20 to allow storage of the artistic material 1, used to create the display sheet 2. Storage of this pocket in the final sheet container 22, illustrated in FIGS. 23 and 24, assures ease of access to the creative materials in future creative efforts.

Although 8 ½×11 inch sheet sizes are preferred, any size sheets may be used, so long as the display sheets, frame means, sheet holders, and final sheet container are all identically sized to one single, common, and standard size.

Figure 2:
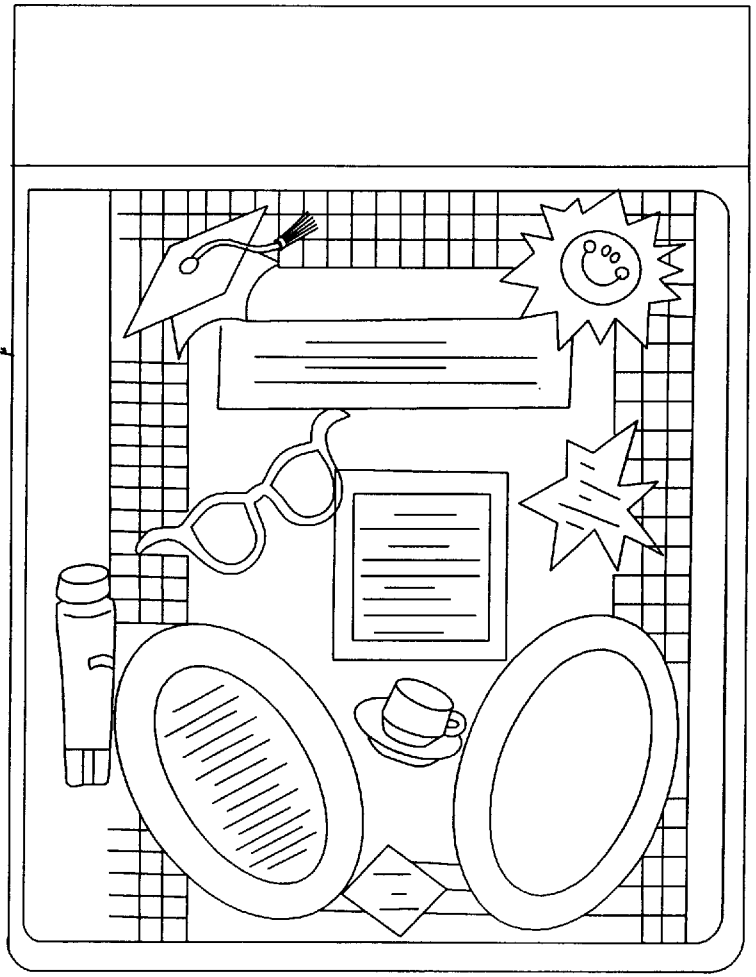
FIG. 2 is a front view perspective of the apparatus of the present
Figure 1:
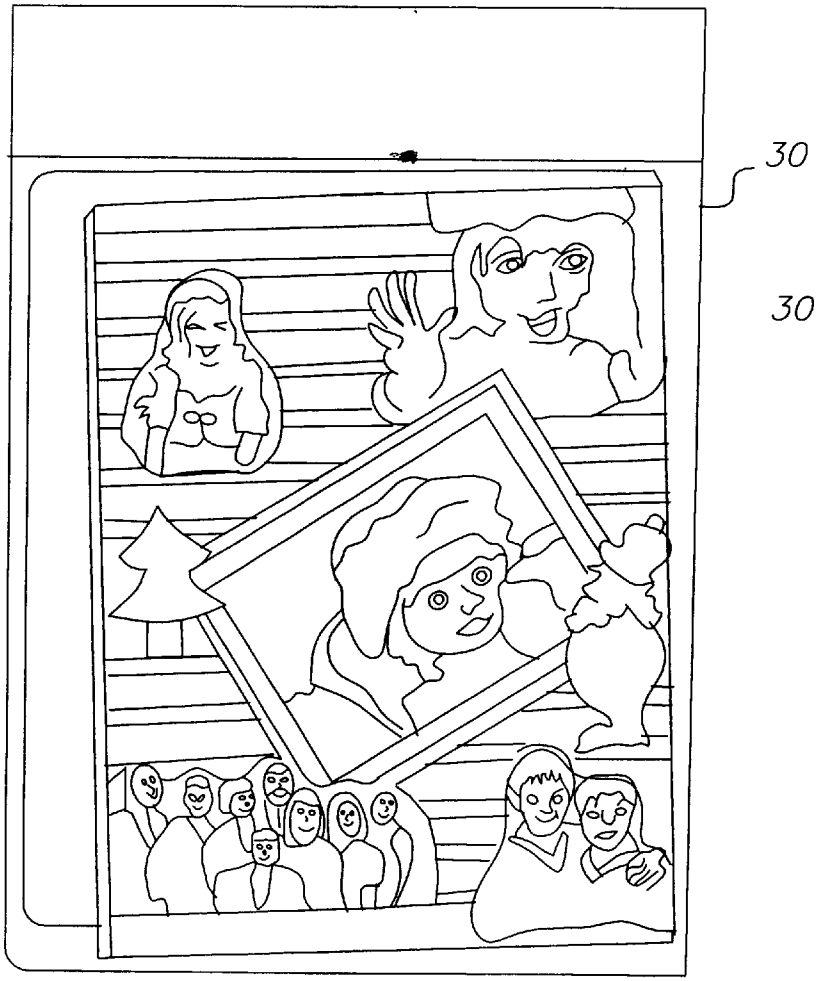
FIG. 1 is a back view perspective of the apparatus of the present invention.

The preferred embodiment of the apparatus comprises a packaging means 30, illustrated in FIGS. 1 and 2, containing components similar to those described in the kit above.

To use the kit, memorabilia is assembled. The memorabilia is/are affixed to the standard sized sheets and decorated with the representative artistic materials. Once a pleasing display has been created on the standard sized display sheet, the display sheet is placed in the frame means which is then exhibited. When the display creator tires of the display, the display sheet is removed from the frame means and placed directly into the sheet holder, which is then, in turn, placed directly into the final sheet container. An archival display or scrapbook has instantly been created upon insertion of the display sheet into the sheet holder in the final sheet container.

A new display sheet is now created using the artistic materials and placed in the frame means for display, thus starting the process over. If the optional pocket organizer has been included in the kit, the artistic materials used to create the new display are already at the creator's finger tips, since they have been stored in the pocket which has been, in turn, stored in the final sheet container.

Since a preferred embodiment of the invention has been illustrated and described in detail, it will be apparent that various changes will be made in the disclosed embodiment without departing from the scope or spirit of the invention.

What is claimed is:

1. A kit comprising:

an assortment of decorative materials to assemble a display sheet having a standard size, including at least one said display sheet having said standard size;

a frame means of said standard size for containing said display sheet having said standard size;

and for attachment to a display surface for viewing;

a final sheet container of said standard size for storing and viewing said display sheet after removal from said frame means, comprising:

a binder means for binding; and at least one sheet holder, having an attachment means to allow attachment to said final sheet container by said binder means, and of said standard size, and also having at least one opening to allow addition of said display sheet.

2. The kit of claim 1 wherein said final sheet container further comprises:

an organizing pocket, having an attachment means to allow attachment of said organizing pocket to said final sheet container by said binder means, said organizing pocket further comprising an opening to allow addition of said assortment of decorative material.

3. The kit of claim 1 wherein said display surface is a refrigerator.

4. The kit of claim 1 wherein said standard size is 8.5 inches by 11 inches.

5. An apparatus for creating displaying and storing memorabilia comprising:

a packaging means for packaging components; and components, contained within said packaging means, comprising:

an assortment of decorative materials to assemble a display sheet having a standard size, including at least one said display sheet having said standard size;

a frame means of said standard size for containing said display sheet and for attachment to a display surface for viewing;

a final sheet container of said standard size for storing and viewing said display sheet having said standard size after removal from said frame means, comprising:

a binder means for binding; and at least one sheet holder, having an attachment means to allow attachment to said final sheet container by said binder means, and of said standard size, and also having at least one opening to allow addition of said display sheet.

6. The apparatus of claim 5 wherein said final sheet container further comprises:

an organizing pocket, having an attachment means to allow attachment of said organizing pocket to said final sheet container by said binder means, said organizing pocket further comprising an opening to allow addition of said assortment of decorative material.

7. The apparatus of claim 5 wherein said display surface is a refrigerator.

8. The apparatus of claim 5 wherein said standard size is 8.5 inches by 11 inches.

9. A method for displaying and organizing memorabilia comprising:

a. assembling decorative materials and said memorabilia into a display sheet having a standard size;

b. placing said display sheet into a frame means of said standard size for containing said display sheet and for attachment to a display surface for viewing;

c. displaying said display sheet in said frame means;

d. transferring said display sheet directly to a sheet holder of said standard size;

e. placing said sheet holder directly into a final sheet container of said standard size;

f. storing and displaying said display sheet contained in said sheet holder in said final sheet container.

10. The method of claim 9 wherein said standard size is 8.5 inches by 11 inches.

* * * * *